United States Patent [19]

Campello et al.

[11] Patent Number: 4,555,020

[45] Date of Patent: Nov. 26, 1985

[54] COMPACT

[75] Inventors: Ugo Campello; Enrico Racca, both of Miami, Fla.; Pierluigi Sosta; Deris Baggiolini, both of Concesio, Italy

[73] Assignee: New High Glass, Miami, Fla.

[21] Appl. No.: 643,819

[22] Filed: Aug. 23, 1984

[51] Int. Cl.[4] ..... A47B 67/00

[52] U.S. Cl. ..... 206/235; 206/581; 206/38; 206/823; 132/83 R; 132/82 C

[58] Field of Search ..... 206/235, 581, 38, 1.7, 206/1.8, 1.9, 823; 132/79 C, 79 G, 82 D, 82 F, 83 R; 220/DIG. 26

[56] References Cited

U.S. PATENT DOCUMENTS

| | | | |
|---|---|---|---|
| 1,625,455 | 4/1927 | Corry | 132/83 R |
| 2,010,521 | 8/1935 | Kreisler | 220/20 |
| 2,465,946 | 3/1949 | Velez | 132/83 R |
| 2,534,100 | 12/1950 | Baumgartner | 206/235 |
| 3,637,278 | 1/1972 | Easterbrooks | 132/83 R |
| 3,918,920 | 11/1975 | Barber | 206/306 |
| 3,941,237 | 3/1976 | MacGregor, Jr. | 206/306 |

FOREIGN PATENT DOCUMENTS

| | | | |
|---|---|---|---|
| 668617 | 11/1929 | France | 206/235 |
| 802303 | 9/1936 | France | 132/82 C |
| 943224 | 3/1949 | France | 132/79 C |
| 987042 | 8/1951 | France | 206/235 |
| 2470555 | 6/1981 | France | 206/823 |
| 426283 | 4/1935 | United Kingdom | 206/1.8 |

*Primary Examiner*—William T. Dixson, Jr.
*Assistant Examiner*—Brenda J. Ehrhardt
*Attorney, Agent, or Firm*—Anthony J. Casella; Gerald E. Hespos

[57] ABSTRACT

An improved compact is provided for storing a plurality of articles of convenience. The compact includes a cental compartment with a hinged top that is lockable in a closed condition. The compact further includes a plurality of side housings which are constructed to frictionally engage removable side compartments. The side compartments are adapted to be frictionally locked into the side housings. Additionally the handles of the compartments are formed to prevent rotational movement of the handle relative to the remainder of the compartment while the compartment is engaged in its appropriate side housing.

11 Claims, 7 Drawing Figures

COMPACT

RELATED APPLICATIONS

This application relates to copending Design patent application Ser. No. 671,472, filed by the above identified inventors on Nov. 14, 1984 and entitled COMPACT.

BACKGROUND OF THE INVENTION

Compacts are used primarily by women to store a variety of cosmetics and toiletry articles. Small cases structurally and functionally similar to the typical compact also are employed by both men and women to store pens, pencils, calculators, pads of paper, tobacco products and lighters.

Most available compacts are able to store only a very small number of related articles. One of the more commonly used compacts merely includes a base portion which houses a particular type of cosmetic and a hinged top which houses a mirror. The mirror can be used for a variety of personal grooming functions, and is particularly adapted to facilitate the application of the cosmetic. Many women carry at least one such prior art compact with them at all times, along with a plurality of containers which store related cosmetic and toiletry articles. For example, a woman may carry a compact in which a powder base and a mirror are housed. A second compact may also be carried in which eye shadow, rouge and other such products are stored. Several smaller containers may also be carried for mascara, eyeliner, lipstick, perfume, cologne and other related toiletry articles.

Desirably all containers for toiletry articles should be sufficiently small to enable one or more of the containers to be carried in the woman's handbag. The small size also facilitates the easy manipulation of the container in environments where the woman is not afforded the luxury of spreading the containers out on a dressing table, sink top or such. The small size of the containers should not, however, affect the ability to obtain access to the cosmetic or toiletry articles stored therein.

Among the many known compact designs, one rather recent design is shown in U.S. Pat. No. 4,388,935 which issued to Napolitane on June 21, 1983. The compact shown in U.S. Pat. No. 4,388,935 is a hingeless structure including a base in which a plurality of cosmetic articles are placed and a cover which slideably envelopes at least part of the base structure.

Other compacts are shown in U.S. Pat. No. 1,453,563 which issued to Albert; U.S. Pat. No. 1,837,722 which issued to McAtree; U.S. Pat. No. 1,875,541 which issued to Zell; U.S. Pat. No. 2,031,933 which issued to Klegg; U.S. Pat. No. 3,179,891 which issued to Sharma; and U.S. Pat. No. 3,431,918 which issued to Neumann et al. Several of the above identified patents show compacts having a plurality of separate compartments. This attempt to develop compacts having several compartments reflects the recognized desire to minimize the number of separate containers that must be carried about to carryout personal grooming functions. More particularly, to the extent that a compact can consolidate the various products required to attend to one's personal grooming needs, the less cluttered the woman's pocketbook is likely to be.

In view of the above, it is an object of the subject invention to provide a compact that can easily store a plurality of cosmetic, toiletry, and other articles.

It is another object of the subject invention to provide a compact that is sufficiently small to be easily fit in a woman's pocketbook and to be easily manipulated during use.

It is an additional object of the subject invention to provide a compact that will securely retain the plurality of articles stored therein.

It is a further object of the subject invention to provide a compact that enables easy access to each of the articles stored therein.

It is still another object of the subject invention to provide a compact that is aesthetically attractive.

It is still an additional object of the subject invention to provide a compact that readily can accept interchangeable inserts to replace items that have been completely used and to vary the assortment of articles that will be carried on any particular day.

SUMMARY OF THE INVENTION

The subject invention is directed to a compact having a central hinged top portion for storing certain cosmetic articles plus a plurality of side compartments for receiving other cosmetics or toiletry articles. More particularly, the center compartment includes a hinged top which can rotate approximately 90° away from the compact and which includes a mirror to facilitate personal grooming. At least one tray for housing cosmetic articles or the like is provided in the central hinged top portion. Preferably a pair of trays is provided with the first tray being fixedly secured in the base of the center compartment and with the second tray being slideably attached to the first tray such that the second tray effectively acts as a cover to the first tray. Thus the second tray can be slideably pulled at least partly out of the compartment to provide access to the first tray. In the preferred embodiment the two trays define an insert frictionally engaged in the center compartment. The bottom tray further includes a pair of rails which engage rails on the top compartment to enable slideable movement therebetween. Preferably the rails are provided with stops which prevent complete removal or spillage of the contents in the top tray.

The hinge top preferably includes a closure which prevents the accidental opening of the cover, yet enables a relatively easy intentional opening of the cover. For example, the cover may formed from a material that can be deformed slightly upon the application of pressure adjacent the opening edge. This pressure can deform the cover sufficiently to enable interlocking members to become disengaged from one another.

The side containers are removably mounted in side housings that are integrally connected to and preferably unitary with the central compartment. In a preferred embodiment, described further below, each side compartment can be slideably inserted in and removed from its respective side housing. More particularly each side housing includes a plurality of inwardly extending ribs which are dimensioned to frictionally engage the compartment to be inserted therein. Each side compartment can include a handle portion, a locking portion disposed adjacent the handle portion and a container portion extending from the locking portion. The handle portion is constructed to lie entirely outside the housing, and to generally conform to the contour of the entire compact thereby enhancing the aesthetic appeal of the compact and rendering the compact easy to manipulate. The locking portion is of a slightly greater diameter than the container portion. Thus, the container portion can be slideably inserted into the housing portion and guided therein by the inwardly extending ribs. The locking portion, with a slightly greater dimension than the compartment portion, can be urged into the housing to be frictionally engaged by the inwardly extending ribs.

A plurality of side compartments can be provided. More particularly the compact typically will include at least two side compartments, with one side compartment being disposed on each of the opposed sides of the central compartment. However, a greater number of side compartments can be provided, with at least two such side compartments being disposed on each side of the central compartment, with one such side compartment being inserted from the front and the other being inserted from the rear of the compact. These smaller side compartments are particularly well adapted to perfumes and colognes. In certain applications, as explained herein, two small side compartments could be mounted on one side of the central compartment and one larger side compartment could be mounted on the opposed side of the central compartment.

Although the following detailed description illustrates the use of the subject compact with cosmetics, it is understood that the structure described herein can be used with a variety of commonly used products such as cigarette lighters, writing instruments, an electronic calculator and other such useful articles and devices.

DETAILED DESCRIPTION OF THE PREFERRED EMBODIMENT

Figure 1:
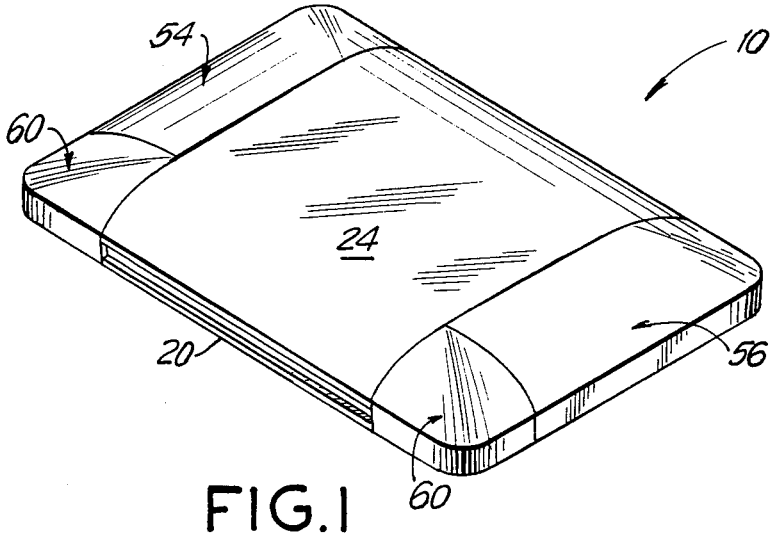
FIG. 1 is a perspective view of the compact of the subject invention in a closed condition.
Figure 2:
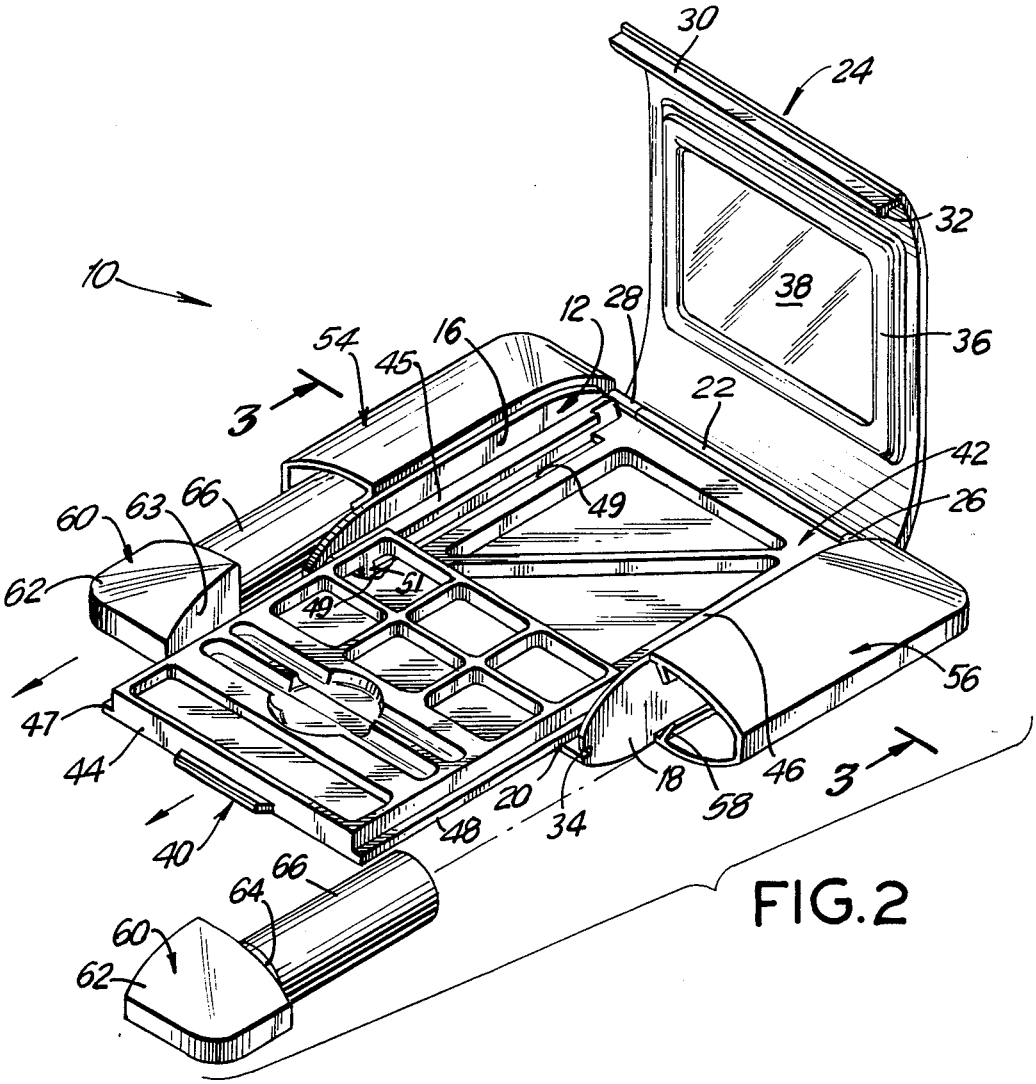
FIG. 2 is an exploded perspective view of the compact of the subject invention in an opened condition.
Figure 3:
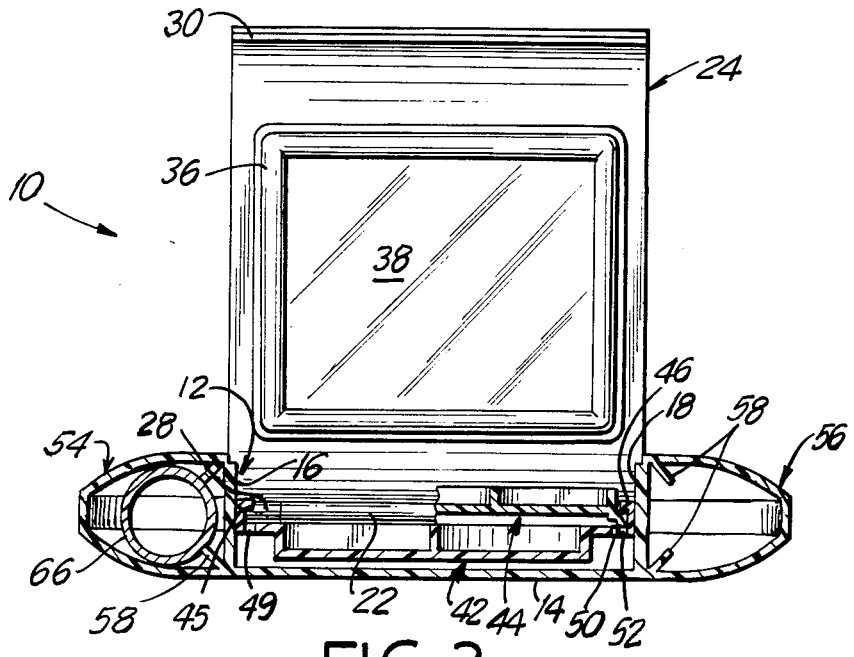
FIG. 3 is a cross-sectional view taken along lines 3—3 in FIG. 2.

The compact of the subject invention is indicated generally by the numeral 10 in FIGS. 1 through 3. The compact 10 includes a central compartment 12 defined by a base wall 14 and a pair of opposed side walls 16 and 18. The base wall 14 is generally arcuate and includes opposed front and rear edges 20 and 22. The rear edge 22 defines a cylindrical member that can receive a hinge bar (not shown) to enable the hinged mounting of top 24. The top 24 includes a rear edge defined by spaced apart cylindrical members 26 and 28 which are disposed to substantially engage and straddle the cylindrical rear edge member 22 of the base wall 14. A hinge bar or other appropriate hinged connection member may then be slideably inserted through the cylindrical members 22, 26 and 28 to hingedly connect the top 24 to the base 18. The top 24 further includes a front wall 30 which is provided with a locking lip 32. The locking lip 32 is dimensioned to engage notches 34 which are formed in the side walls 16 and 18 of the center compartment 12. When the cover 24 is in its closed condition with respect to the base wall 14, the locking lip 32 will engage the notches 34 to securely keep the cover 24 in its closed condition. However, an upward force on the front 30 of the cover 24 will sufficiently deform the cover 24 to disengage lip 32 from the notches 34.

The cover 24 also is provided with a frame 36 disposed on the inwardly facing surface thereof. The frame 36 houses a mirror 38 which can be used to facilitate personal grooming with the compact 10.

A tiered tray membr 40 is mounted in the center compartment 12 of compact 10. The tiered tray member 40 includes bottom and top trays 42 and 44 respectively. Bottom side rails 45 and 46 are securely connected to but spaced from the bottom tray 42. Top side rails 47 and 48 extend from the bottom side of the top tray 44. The top rails 47 and 48 are in sliding engagement with the bottom rails 45 and 46 to enable the top tray 44 to be moved relative to the bottom tray 42.

To limit the extent of slideable movement between the bottom and top trays 42 and 44, the bottom tray is formed with a pair of slots 49 and 50 as shown best in FIG. 3. The slots 49 and 50 extend generally parallel to and adjacent the bottom rails 45 and 46. The top tray 44 is further provided with locking protrusions 51 and 52 which extend downwardly from the rearward portions of the top rails 47 and 48. The protrusions 51 and 52 are slideably engaged in the slots 49 and 50 respectively. Thus, the sliding interengagement of the top rails 47 and 48 with the bottom rails 45 and 46 prevents rotational movement of the top tray 44 with respect to the bottom tray. Simultaneously the protrusions 51 and 52 limit the slideable movement of the top tray 44 relative to the bottom tray 42. By virtue of this cooperation between the above recited structural elements, the top and bottom trays 44 and 42 are retained in substantially parallel planes and are substantially prevented from being removed from one another. It should be noted, however, that in a preferred embodiment the assembly 40 of the bottom and top trays 42 and 44 can be securely but removably mounted in the compact 10 to enable periodic replacement of the cosmetics stored in the trays 42 and 44.

Unitary with the side and base walls 16, 18 and 14 respectively are the side housings 54 and 56. The side housings 54 and 56 each include a plurality of inwardly extending ribs 58. The ribs 58, as shown most clearly in FIG. 3, are radially aligned with respect to one another. Additionally, the innermost edges of the ribs 58 in each housing 54 or 56 are parallel to one another and define radii of a cylindrical passage that is tangent to the walls of housing 54 and 56.

Compartments 60 are provided to be inserted in a side housing 54 or 56. Each compartment 60 is specifically adapted to retain a cosmetic or toiletry article or other article of convenience. As illustrated most clearly in FIGS. 2 through 5, each compartment 60 is provided with a handle portion 62 which can be readily grasped by the user of compact 10. The handle portion 62 preferably is configured to conform generally to the shape of compact 10 as illustrated most clearly in FIGS. 1 and 2. Disposed adjacent the handle 62 is a generally cylindrical locking rim 64. The locking rim 64 has a diameter "b" equal to, or preferably slightly greater than the diameter of the cylinder defined by ribs 58 in each side housing 54 and 56 of compact 10. Container 66 extends from the locking rim 64. Preferably the container 66 is of generally cylindrical configuration with a diameter "c" which is less than the diameter "b" of the locking rim 64 and is equal to or less than the diameter defined by the ribs 58 in the side housings 54 and 56 of compact.

The compartment 66 can be adapted to accept a wide range of articles of convenience. For example, compartment 66 could be a dispenser for lipstick. If compartment 66 is adapted to retain lipstick the container 66 generally would be rotatable with respect to the handle 62 and appropriate well known internal mechanisms would be provided to enable the axial advancement of the lipstick relative to container 66. Similarly, container 66 could be adapted to retain mascara. In this instance the handle 66 also would function as the handle of a mascara applicator centrally disposed within container 66. Consequently an appropriate means, such as arrays of threads, would be provided to enable the mascara applicator to be selectively removed from the container 66. In a similar manner the container 66 could contain a liquid such as perfume or cologne, with the handle 62 functioning as a cap to the container 66. In still other embodiments, the container 66 could house nail polish, a cigarette lighter, a writing instrument or other such article of convenience. In still other embodiments the container 66 could house a dry cell battery to operate a small light within the compact 10 or to operate an electrical instrument, such as a calculator. It also should be noted that it is not essential for the container 66 to be cylindrical.

Regardless of the function of container 66, the retention of the compartment 60 in the housing 54 or 56 would be substantially the same. More particularly the compartment 60 would be advanced in an axial direction into the housing 54 or 56. Because the diameter "c" of the container 66 is less than or equal to the diameter defined by ribs 58, this initial advancement of compartment 60 into the housing 56 or 58 would be relative easy. However, upon complete insertion of the compartment 60 into the housing 56 or 58, the locking rim 64 would engage the ribs 58. As noted above, the diameter "b" defined by the locking rim 64 is greater than or equal to the diameter defined by the inwardly extending ribs 58. Consequently the locking rim 64 would be frictionally engaged by the ribs 58. To remove the compartment 60 from the side housing 54 or 56 the user would grasp the handle 62 and exert an axial force on the compartment sufficient to overcome the frictional engagement between the locking rim 64 and the ribs 58.

Figure 4:
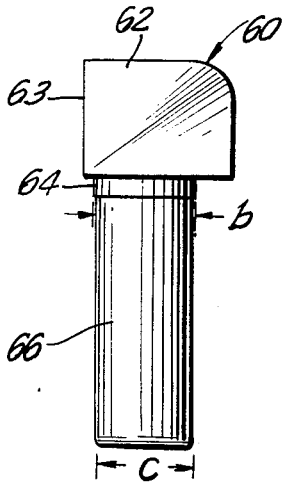
FIG. 4 is a plan view of a side compartment of the compact of the subject invention.
Figure 6:
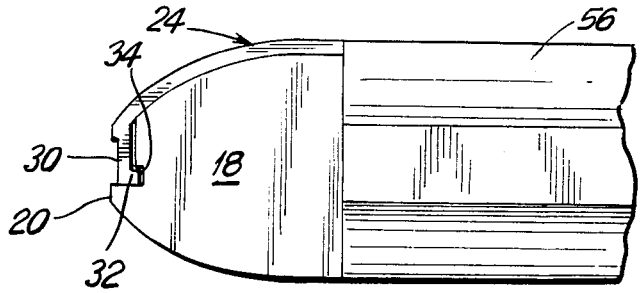
FIG. 6 is a side view of the compact of the subject invention with the side compartment thereof removed.
Figure 5:
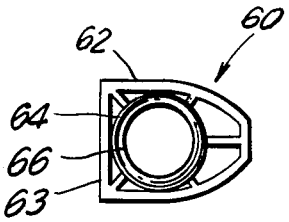
FIG. 5 is an end view of the side compartment showin in FIG. 4.

As shown most clearly in FIGS. 2, 4 and 5, the handle 62 of compartment 60 is provided with a planar surface 63 which is of generally the same contoured configuration as the ends of side walls 16 and 18. Thus, as the compartment 60 is slideably inserted into the side housing 54 or 56 the planar surface 63 substantially abuts a portion of the side wall 16 or 18. This abutment between side wall 16 or 18 and planar surface 63 substantially prevents rotational movement of the compartment 60 within the side housing 54 or 56. Consequently it is not possible for the handle 62 to rotate relative to the container 66 while the compartment 60 is securely seated in the side housing 54 or 56. Thus, when the handle 62 functions as a cap for container 66, there is no chance of the container 66 becoming unintentionally opened while stored in a pocketbook or the like. Additionally, this inability of the handle 62 to rotate once it has been fully seated substantially prevents the compartment 60 from becoming unintentionally separated from the housing 54 or 56. More particularly, any unintended contact with the completely closed compact 10 is not likely to overcome the frictional engagement between the locking rim 64 of compartment 60 and the side housing 54 or 56. Rather, the compartment 60 can only be removed from the side housing 54 or 56 by an axial force exerted thereon. This axial force could not be caused by an unintended contact with the closed compact 10 because of the contoured configuration.

Figure 7:
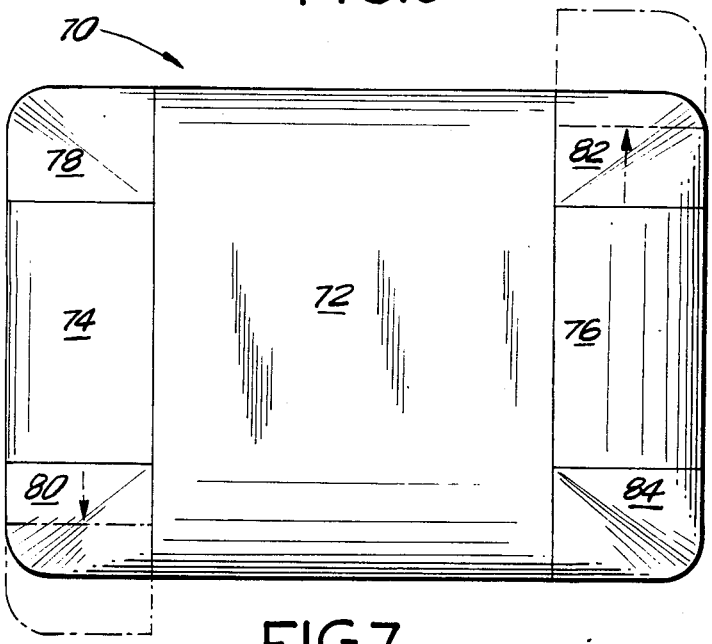
FIG. 7 is a plan view of an alternate embodiment of the subject compact.

Turning to FIG. 7, an alternate embodiment of the subject invention is shown. More particularly, the compact 70 shown in FIG. 7 includes a hinged top 72 substantially identical to the hinged top 24 described above. Additionally, the compact 70 includes side housings 74 and 76 which can accept compartments 78, 80, 82 and 84 from either direction. The compartments 78 through 84 are convenient for storing smaller supplies of material, such as perfumes. The internal construction of each compartment 78 through 84 is substantially identical to the construction of container 60 described above, including the existence of a locking rim which engages inwardly extending ribs on side housings 74 and 76.

In summary an improved compact is provided for conveniently storing a plurality of articles of convenience. The compact includes a central container with a lockable hinged top. The center container may include two tiers of cosmetics in slideable relationship to one another. The tiers preferably are constructed to prevent accidental tipping of one tier relative to the other and to prevent complete removal of the top tier relative to the bottom tier. Side housings are disposed adjacent to the center compartment. The side housings include inwardly extending ribs which define a generally cyindrical array. Compartments are provided for mounting in the side housings. Each compartment includes a handle which conforms to the general shape of the compact, a locking rim which is frictionally engageable with the ribs of the housings, and a container portion for holding an appropriate article of convenience. The handle preferably is constructed with at least one planar surface which can abut a wall of the central compartment to prevent rotational movement of the handle relative to the remainder of the compartment.

While the invention has been described with respect to a preferred embodiment, it is obvious that various modifications can be made therein without departing from the spirit of the present invention which should be limited only by the scope of the claims. Specifically, it should be noted that the compact can be provided with any number of side compartments. Also, the compact can be used to store a broad range of articles of convenience and not just cosmetics and toiletries.

What is claimed is:

1. A multicompartment compact comprising:

a center compartment including a base wall and spaced apart upstanding side walls connected to and extending from said base wall;

a bottom tray removably mounted in said center compartment;

a top tray slideably mounted to said bottom tray such that in a first position said top tray covers said bottom tray and such that in a second position said top tray enables access to said bottom tray, said top and bottom trays including means for preventing separation of said top tray from said bottom tray;

a top hingedly connected to and adapted to enclose said center compartment;

a pair of side housings connected respectively to the side walls of said center compartment, each said side housing defining an enclosure having at least one opened end;

and at least one side compartment frictionally retained in each said side housing, each said side compartment including a handle portion and a container portion attached to said handle portion, said container portion being slidably disposed in the respective side housing, said handle portion of each said side compartment including a wall engaging the respective side wall of the center compartment and preventing rotation of said handle relative to said side wall when said side compartment is in one of said side housings.

2. A container as in claim 1 wherein said top is hingedly connected to said base wall of said center compartment.

3. A container as in claim 2 wherein said top includes a front edge disposed opposite the hinged connection of said top, said front edge including locking means for releasably locking said top in closed relationship to said center compartment.

4. A container as in claim 3 wherein said locking means includes at least one rib and wherein said side walls of said center compartment each include a notch dimensioned to releasably retain said rib.

5. A container as in claim 1 further including a mirror attached to said top.

6. A container as in claim 1 wherein the side walls of said center compartment are generally parallel to one another.

7. A container as in claim 1 wherein said means comprises a pair of bottom rails connected to said bottom tray and a pair of top rails connected to said top tray said top and bottom rails being in slideable relationship to one another.

8. A container as in claim 7 wherein said means for preventing removal of said top tray further comprises a pair of slots in said bottom tray and a pair of protrusions extending from said top tray and slideably engaging said slots.

9. A container as in claim 1 wherein each said side housing includes an array of inwardly extending ribs.

10. A container as in claim 9 wherein the array of inwardly extending ribs defines a generally cylindrical passage in each said housing.

11. A container as in claim 9 wherein each said side compartment further includes a locking rim disposed intermediate said container portion and said handle portion, said locking rim being dimensioned to be frictionally engaged by the ribs of the respective side housing.

* * * * *